US011529713B2

(12) United States Patent
Megerle et al.

(10) Patent No.: US 11,529,713 B2
(45) Date of Patent: Dec. 20, 2022

(54) ENDLESS ABRASIVE BELT FOR A SANDING MACHINE

(71) Applicant: VSM Vereinigte Schmirgel- und Maschinen-Fabriken AG, Hannover (DE)

(72) Inventors: Clemens Megerle, Hannover (DE); Henning Dammer, Wunstorf (DE); René Vogt, Siegburg (DE)

(73) Assignee: VSM Vereinigte Schmirgel- und Maschinen-Fabriken AG, Hannover (DE)

( * ) Notice: Subject to any disclaimer, the term of this patent is extended or adjusted under 35 U.S.C. 154(b) by 785 days.

(21) Appl. No.: 16/552,074

(22) Filed: Aug. 27, 2019

(65) Prior Publication Data

US 2020/0070305 A1 Mar. 5, 2020

(30) Foreign Application Priority Data

Aug. 29, 2018 (DE) ..... 10 2018 121 139.2

(51) Int. Cl.

| | |
|---|---|
| ***B24B 49/10*** | (2006.01) |
| ***B24B 49/16*** | (2006.01) |
| ***B24B 21/04*** | (2006.01) |
| ***B24B 21/20*** | (2006.01) |
| ***B24B 21/00*** | (2006.01) |
| ***B24B 49/00*** | (2012.01) |

(52) U.S. Cl.

CPC ..... *B24B 49/10* (2013.01); *B24B 21/004* (2013.01); *B24B 21/04* (2013.01); *B24B 21/20* (2013.01); *B24B 49/006* (2013.01); *B24B 49/16* (2013.01)

(58) Field of Classification Search

CPC ..... B24B 49/006; B24B 49/10; B24B 49/105; B24B 49/16; B24B 21/004; B24B 21/02; B24B 21/04; B24B 21/10; B24B 21/12; B24B 21/20

USPC ..... 451/4, 5, 8, 59, 296, 299

See application file for complete search history.

(56) References Cited

U.S. PATENT DOCUMENTS

| | | | | |
|---|---|---|---|---|
| 4,205,490 A * | 6/1980 | Evans | ..... | B24B 21/18 451/296 |
| 5,392,567 A * | 2/1995 | Nagai | ..... | B29D 29/00 451/10 |
| 5,484,323 A * | 1/1996 | Smith | ..... | B24B 53/10 451/6 |

(Continued)

FOREIGN PATENT DOCUMENTS

| | | |
|---|---|---|
| DE | 20 2014 104 310 U1 | 12/2015 |
| DE | 10 2014 224 570 A1 | 6/2016 |

(Continued)

*Primary Examiner* — Eileen P Morgan

(74) *Attorney, Agent, or Firm* — Cohard & Roe, P.C.

(57) ABSTRACT

An endless abrasive belt for a sanding machine includes a flexible support structure, on an upper side of the support structure, an active layer with a binder and abrasive grains held in the binder. A transponder device is affixed to an underside of the endless abrasive belt, the transponder device including an attachment region and a flag, the attachment region being glued onto the underside by an adhesive layer, the flag being held by the attachment region and projecting laterally away from the endless abrasive belt, and a transponder including a transponder chip and an aerial for a wireless data connection with the sanding machine is arranged in the flag.

23 Claims, 2 Drawing Sheets

(56) References Cited

U.S. PATENT DOCUMENTS

Figure 1:
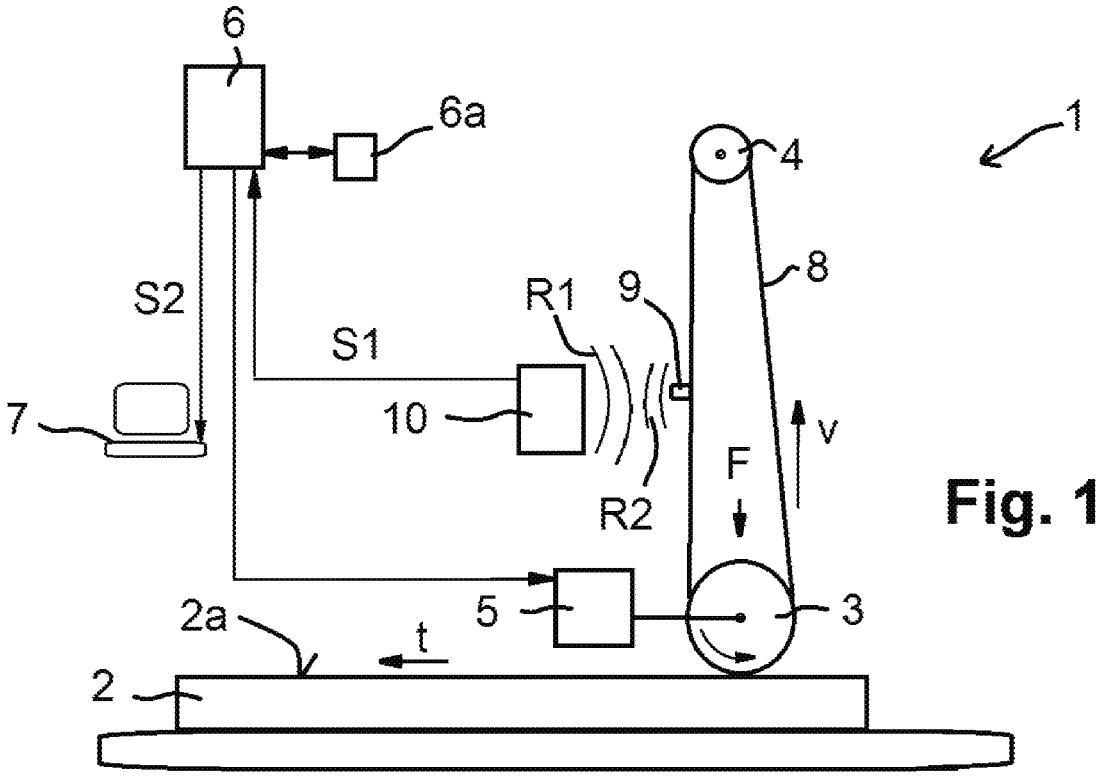

| | | | | |
|---|---|---|---|---|
| 6,288,443 | B1 | 9/2001 | Finn et al. | |
| 10,245,718 | B2 | 4/2019 | Glauning | |
| 2019/0232455 | A1* | 8/2019 | Bettermann | B24B 49/10 |
| 2020/0030936 | A1* | 1/2020 | Knudson | B24B 49/006 |
| 2020/0030938 | A1* | 1/2020 | Knudson | B24B 49/14 |
| 2022/0219281 | A1* | 7/2022 | Anderson | B02B 3/04 |

FOREIGN PATENT DOCUMENTS

| | | | | | |
|---|---|---|---|---|---|
| DE | 10 2016 211 937 | A1 | | 1/2018 | |
| DE | 10 2016 214 568 | A1 | | 2/2018 | |
| DE | 102018121139 | B3 | * | 9/2019 | B24B 21/004 |
| EP | 2995421 | A1 | * | 3/2016 | B24B 21/12 |
| EP | 3616841 | A3 | * | 4/2020 | B24B 21/004 |
| GB | 2334468 | A | * | 8/1999 | B24B 21/20 |
| WO | 98/26453 | A1 | | 6/1998 | |
| WO | WO-2008110027 | A1 | * | 9/2008 | B24B 21/20 |
| WO | WO-2020222008 | A1 | * | 11/2020 | A23N 5/08 |

* cited by examiner

ENDLESS ABRASIVE BELT FOR A SANDING MACHINE

CROSS REFERENCE TO RELATED APPLICATIONS

Applicant claims priority under 35 U.S.C. § 119 of German Application No. 10 2018 121 139.2 filed on Aug. 29, 2018, the disclosure of which is incorporated by reference.

The invention relates to an endless abrasive belt for a sanding machine as well as a corresponding sanding machine including such endless abrasive belt.

Endless abrasive belts are used to process, in particular, metal work pieces sometimes using high contact forces for which purpose there are usually clamped between a grinding cylinder and a tension roller of a sanding machine. The work pieces can be transported past the grinding cylinder by means of a transport direction processed by means of the abrasive belt in that the grinding cylinder presses the active side of the endless abrasive belt against the work piece in a defined manner and the defined belt velocity and contact force of the grinding belt create a desired sanding result. Hereby, the endless abrasive belts are subjected to strong forces and deformations; they are guided across the cylinders, sometimes even sliding in addition, across a grinding shoe or another pressing device, whereby they are constantly subject to a tension force and also the pressure force against the work piece.

Hereby, the endless abrasive belt may develop a certain slippage in relation to the cylinders at its back side (passive side); when utilizing a grinding shoe, correspondingly, there will be some sliding friction on its surface so that not only the active side of the abrasive belt with abrasive grains held inside a binder but also the back side formed by the support structure, e.g. a fabric, is exposed to a high degree of deformation and forces as well as mechanical wear.

For the purpose of coordinating industrial manufacturing processes transponders are increasingly applied not only to work pieces but also to the processing mean including abrasives. The document DE 10 2016 211 937 A1 describes a hand-operated machine tool designed as an angle grinder holding a grinding disk as replacement tool. A code is applied on the grinding disk which can be designed, in particular, as an RFID code, with the machine tool comprising an identification unit for identifying the code.

It is apparent, however, that the attachment of such a transponder on an endless abrasive belt is not without problems. Owing to the considerable mechanical load and deformation, RFID structures are destroyed quickly in general. The considerable slippage on the back side of the abrasive belt, too, leads to mechanical wear that may correspondingly damage an RFID transponder.

The citation DE 10 2016 214 568 A1 describes a processing means in which a determined pressure force is transmitted by means of wireless data transmission, in particular, RFID technology, to a controller device.

The document DE 20 2014 104 310 U1 describes a broad belt grinder with an abrasive belt, whereby the position of the tension roller is adjustable by means of an actuator in such a way that the abrasive belt assumes a predetermined position on the grinding cylinder. Hereby, an oscillating signal is input via a control so as to change the position of the endless abrasive belt in a perpendicular direction.

The citation WO 1998/026453 A1 describes a chip module as well as a method for manufacturing the same in which a contact metallization is recessed and, in addition, a coil for realizing a transponder may be provided.

The document DE 10 2014 224 570 A1 describes a protector device for a machine tool which may be designed as an RFID communication device. Hereby, a sensor unit is provided which can detect and capture a characteristic such as e.g. the temperature of the surface of a work piece.

The invention is based on the object of creating an endless abrasive belt for a machine tool and a machine tool of this type allowing for a secure operation and a secure detection of the endless abrasive belt.

This task is solved by an endless abrasive belt according to claim 1. The sub-claims describe preferred further developments. In addition, a sanding machine including said endless abrasive belt is provided.

Thus, a transponder device having a wireless transponder is provided on the endless abrasive belt. Hereby, the transponder device projects laterally away from the abrasive belt so that the transponder lies outside the abrasive belt; thus, the transponder is not pressed on or in-between the rollers and the support structure including, in particular, when clamping the abrasive belt to the rollers.

Hereby, the transponder device may comprise, in particular, an attachment region and a flag, with the attachment region being attached e.g. on the back side of the abrasive belt and carrying the flag which laterally projects beyond the abrasive belt and hosts the transponder.

Thus, in grinding operation or, respectively, when processing the work piece, the active layer of the abrasive belt is pressed against the work piece in the usual manner and guided along the work piece by the grinding cylinder. Owing to the hereby occurring forces and deformations, the transponder housed in the flag and protruding laterally is not affected, at least, not directly.

The transponder may be, in particular, an RFID transponder sein and comprise an RFID chip including an aerial or antenna structure respectively. Thus, the Transponder can be read out wirelessly by a detector of the machine tool, whereby, in particular, the RFID technology also allows for greater distances in reading so that e.g. a single detector is sufficient and established, maybe following a short transport of the abrasive belt, a data communication with the transponder and can read out the data stored in the transponder.

Advantageously, data relevant to the processing procedures can be stored in the transponder, in particular, one or more of the following data: data relating to the series of the abrasive belt, the grain size, a shipment date, as well as processing data such as the pressure force, transport velocity, maximum operating times or processing time respectively, as well as an individual identification number.

Thus, it is possible, even retrospectively, to enable an unambiguous identification of the endless abrasive belt. Therefore, if the abrasive belt should no longer allow for an identification due to abrasion on its back side, and since even e.g. the active layer in the case of modern compact grains can no longer be unambiguously identified by means of the grain size even by an expert, the transponder will still subsequently allow for an unambiguous identification without being exposed to the direct load during processing.

According to a further development, in particular, data related to wear, preferably time of operation and/or distance of operation and/or an evaluation index depending upon wear, formed e.g. as a function of the previous time of operation and the pressure force during such time of operation, may also be written into the transponder, in particular, its transponder chip. In the event that the endless belt will be reused later again in this or another similar machine tool, this data can be read out again.

This allows for an improved utilization of the permissible wear-dependent parameters. Thus, replacement of an endless belt, e.g. even an interruption of a current processing operation in order to e.g. continue operation with the first belt following an intermediate use of another belt, no longer leads to a loss of sanding capacities, whereby, in particular, even errors or insecurities in handling can be avoided.

In accordance with a further embodiment, in the alternative or in addition to storing the wear-dependent data in the transponder, current data storage may also happen in the machine tool—in particular, a writable memory of the machine tool, whereby, in this case, e.g. data sets with individual identification numbers of the endless abrasive belts can be created. Thus, it is possible to insert different endless belts, even for short times of operation, and reused later appropriately so as to utilize the endless belt in an optimum manner.

According to a preferred embodiment, the transponder device is designed to include a plastics strip comprising an adhesive layer; thus, here, in particular, a strip of an adhesive sheet may be provided. The adhesive sheet may directly constitute the attachment region which is glued onto the backside of the abrasive belt or, respectively, the backside of the support structure of the abrasive belt. Preferably, the adhesive strip or the adhesive sheet respectively is flipped over or folded inwards respectively at its protruding end where the Transponder is housed, thereby increasing the stiffness of the so designed flag and covering the adhesive layer in the protruding end. Thus, an adhesive sheet or, respectively, an adhesive strip can be used, with little effort and in s surprisingly simple manner, to create the attachment region including the joining flag which is a little stiffer and no longer adhesive.

The transponder device may, in particular, be housed on a roller as a strip-away strip. Thus, the user will strip off a strip-away strip and flip over the front part including the transponder, for which purpose, advantageously, a desired predetermined bending line or folding line respectively is formed so that the user can flip over the end in a defined manner thereby creating the more rigid and no longer adhesive flag. Then, subsequently, the user may thus glue the transponder device using the attachment region still having the adhesive layer onto the backside of the endless abrasive belt or, respectively, its support structure, already establishing the secure attachment.

Advantageously, the transponder device is designed as an elongated strip, e.g. having a rectangular shape. Hereby, advantageously, the attachment region is applied to the endless abrasive belt at an inclined mounting angle, i.e. it runs, in particular, not perpendicular from the edge to the center of the endless abrasive belt but, rather, at an inclined angle of e.g. between 10 and 80°. Hereby, it is recognized that the adhesive sheet of the attachment region, too, can represent a certain mechanical resistance of the abrasive belt guided across the cylinders and, therefore, when applied at an inclined angle, the front and back edge of the attachment region will not create strong jerking action but, rather, come into contact with the cylinders and perhaps a contact shoe always gradually.

If the attachment region is designed to be shorter, the mounting angle is of less relevance so that the sanding process is not impaired thereby by any relevant degree; thus, it is possible to make the application at a non-inclined angle.

Figure 2:
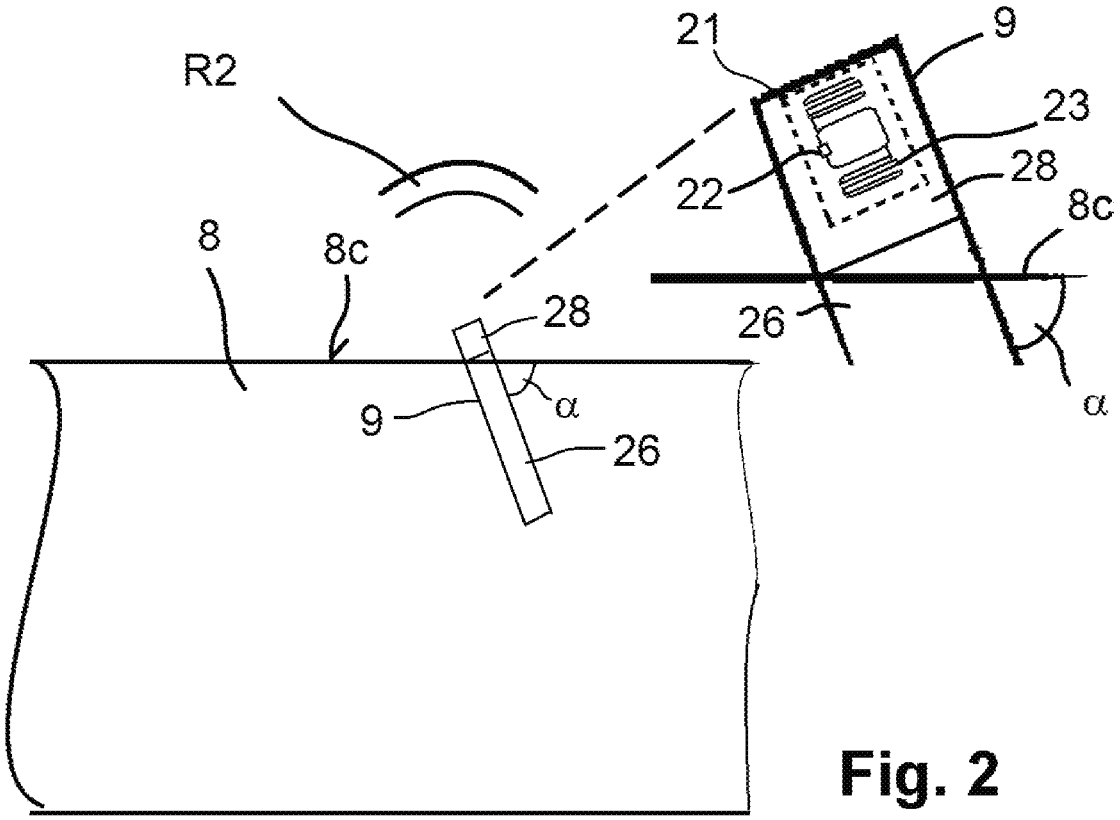
Figure 3:
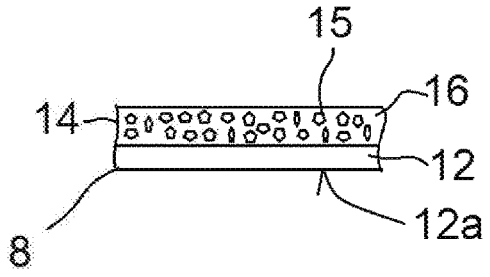
Figure 4:
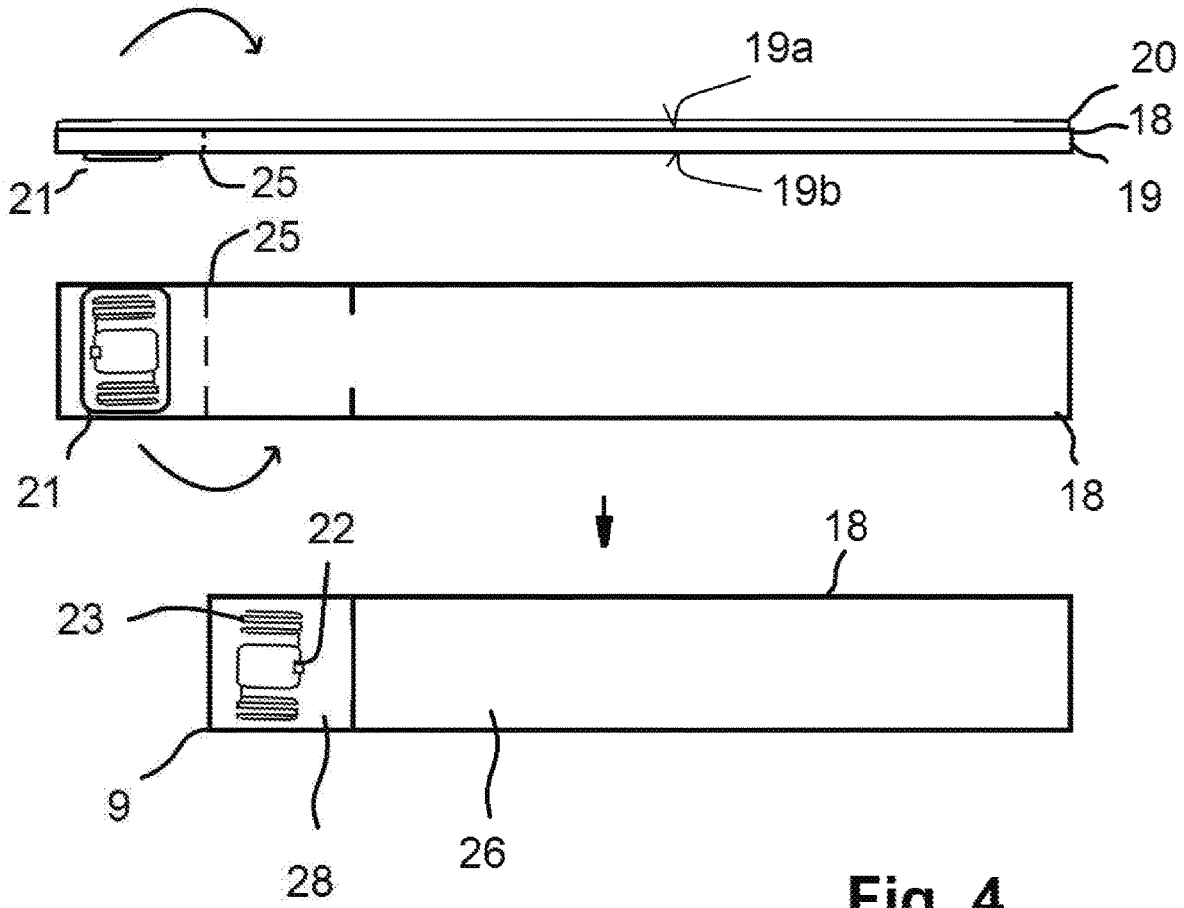

The invention is further illustrated in the following by means of a few embodiment examples by means of the attached drawings. These show in:

FIG. 1 a sanding machine including an endless abrasive belt according to an embodiment of the invention when processing a work piece;

FIG. 2 a top view on the endless abrasive belt in the area of the transponder, with enlarged details;

FIG. 3 a section through the endless abrasive belt according to an embodiment;

FIG. 4 the steps a), b) of the embodiment of the transponder device when using an adhesive sheet.

FIG. 1 shows a sanding machine 1 when processing a work piece 2, which may be e.g. a metal pipe or metal section sein and is conveyed in a transport direction t. The sanding machine 1 comprises a grinding cylinder 3, a tension roller 4, a drive (motor) 5 for driving the grinding cylinder 3 at a belt velocity v, and further a controller device 6 and an input and output unit 7 auf, e.g. including a monitor and keyboard. Furthermore, an endless abrasive belt 8 is clamped between the tension roller 4 and the grinding cylinder 3, and attached to said abrasive belt is a transponder device 9 detected by a detector 10 connected to the controller device 6. To that end, the detector 10 emits RFID query signals R1 which are received by the transponder device 9 which uses them to create and output RFID response signals R2.

The grinding cylinder 3 is pressed against the surface 2*a* of the work piece 2 at a pressure force F or, respectively, a contact pressure, such that the endless abrasive belt 8 acts on the upper side 2*a* of the work piece 2 appropriately. The sanding machine 1 may comprise, in particular, further details, e.g. an oscillation adjustment of the endless abrasive belt 8 in the perpendicular direction by means of a corresponding actuator device, as well as an edge recognition or edge control respectively, but such is not shown here in detail. Also, e.g. the endless abrasive belt 8 may be guided sliding across a shoe or another pressing device.

As can be seen in FIG. 3, the endless abrasive belt 8 comprises a support structure 12 which can be designed e.g. as a fabric, fleece or even paper material. On the support structure 12 the active layer 14 is formed which may comprise, in particular, abrasive grains 15 in a synthetic resin 16. In addition, between the support structure 12 and the active layer 14 an additional adhesive layer—not shown here—may be provided. The abrasive grains 15 may be designed e.g. fully ceramic on the basis of alumina or, alternatively, on the basis of zirconia alumina. In a manner not shown here, the endless abrasive belt 8—as it is customary as such—is formed by e.g. a joint edge at the ends of an abrasive belt or, alternatively, with an overlap to create the endless abrasive belt 8.

The transponder device 9 is affixed on a back side 12*a* of the support structure 12, i.e., thus, the back side of the endless abrasive belt 8. The transponder device 9 comprises an adhesive strip 18 auf, designed as a plastics sheet or, respectively, plastics strip 19 including an adhesive layer 20 at its underside 19*a* and a non-adhesive upper side 19*b*. Preferably, a transponder 21 as an RFID sticker including an RFID chip 22 and aerial 23 is glued flatly onto the non-adhesive upper side 19*b*.

In accordance with FIG. 4, for manufacturing the transponder device 9, the plastics strip 19 is reversibly glued, using its adhesive layer 20 on the underside 19*a*, onto a support, e.g. a substrate for adhesive strips, and the transponder 21 as RFID sticker is glued onto the upper side 19*b*. Thus, e.g., a multiplicity of such transponder devices 9 is made available on a roll. In order to attach it to the endless abrasive belt 8 always one transponder device 9 is drawn off the substrate and, in accordance with FIG. 4*a*, folded along a folding line (predetermined bending line) 25 in such a way that an upper part of the plastics strip 19 including the RFID sticker 21 is folded inwards, whereby the adhesive layer 20 comes into contact with itself. Thus, according to FIG. 4*b*, the transponder device 9 is subsequently formed including a remaining attachment region 26 at the underside of which the adhesive layer 20 is still present, and a flag 28 formed by folding the upper region inwards inside of which Transponder 21 including the RFID chip 22 and the aerial 23 is housed, whereby the flag 28 is non-adhesive and somewhat more rigid by the folding.

Then, the attachment region 26 of the so formed transponder device 9 is glued onto the underside 12*a* of the support structure 12, i.e. the underside of the endless abrasive belt 8, in such a way that it, advantageously, is mounted not perpendicular or, respectively, at a mounting angle $\alpha$ in relation to the edge line, whereby $\alpha \neq 90°$, e.g. $\alpha = 10°$ to $80°$. Thus the attachment region 26 runs at an angle in relation to the running direction or, respectively, transport direction t of the endless abrasive belt 8. The flag 28 is positioned outside of the endless abrasive belt 8, i.e. the flag 28 protrudes laterally.

Thus, in operation of the sanding machine 1, the endless abrasive belt 8 is pressed by the tension roller 4 and the grinding cylinder 3 against the upper side 2*a* of the work piece 2 to be processed, whereby, correspondingly, the back side 12*a* the support structure 12 comes into contact with the cylinders 3, 4. Thus, the attachment region 26, too, comes into contact with the cylinders 3, 4, whereby, owing to its angular attachment on the cylinders, provides relatively low resistance and, in particular, no jerking action during sanding. Die flag 28 including the transponder 21, i.e. the RFID chip 22 and the aerial 23, protrudes laterally and is, therefore, not clamped. In particular, the transponder 21 is not mechanically stressed between the grinding cylinder 3 and the work piece 2.

The detector 10 may be positioned next to the endless abrasive belt 8, i. h. one of the strands. However, because the RFID technology, also allows for larger detection distances here, the detector 10 may be positioned also at a larger distance from the endless abrasive belt 8. The detector 10 correspondingly reads out the RFID transponder 21 contactless by putting out the RFID query signals R1 and receiving the RFID response signals R2, whereby the RFID-Transponder 21 correspondingly functions as a passive transponder. Subsequently, the detector 10 puts out a detection signal S1 to the controller device 6, which in turn correspondingly triggers the drive 5 for the grinding cylinder 3. The user can check the data stored on the RFID chip 22 at any time via the input and output device 7. Moreover, the controller device 6 can also put out warning signals S2 to the input and output device 7 if the settings stored on the RFID chip 22 do not match the working parameters set via the controller device 6 such as pressure force F, belt velocity v etc., or if, generally, a non-matching endless abrasive belt 8 is in use.

In a further development it is possible via the detector 10 to write onto the RFID chip 22, using an appropriate RFID chip 22 and an active writing detector 10. Hereby, it is possible, in particular, to store data relating to wear, e.g. the time of operation and/or distance of operation, and/or an evaluation index created e.g. from the time of operation and a pressure force and evaluating the previous wear.

Furthermore, it is also possible to store data relating to wear, e.g. the time of operation and/or distance of operation, together with an identification number of the endless abrasive belt 8, in the machine tool 1, e.g. a memory 6*a*, provided internally or externally of the controller device 6, whereby the memory 6*a* may also be combined with the input and output device 7.

LIST OF REFERENCE NUMERALS

1 sanding machine
2 work piece
3 grinding cylinder
4 tension roller
5 drive
6 controller device
6*a* memory, in particular, for writing and reading
7 input and output device
8 endless abrasive belt
9 transponder device
10 detector
12 support structure, e.g. fabric
12*a* underside of the support structure 12
12*b* upper side of the support structure 12
14 active layer of the endless abrasive belt 8
15 abrasive grain
16 binder, synthetic resin
18 adhesive strip
19 plastics strip
19*a* underside
19*b* upper side, non-adhesive
20 adhesive layer
21 RFID sticker
22 RFID chip
23 aerial
25 predetermined bending line
26 attachment region
28 flag
t transport direction
F contact pressure force
v belt velocity
R1 RFID query signals
R2 RFID response signals
S1 detection signal
S2 warning signal
$\alpha$ mounting angle

The invention claimed is:

1. An endless abrasive belt (8) for a sanding machine (1), said endless abrasive belt (8) comprising:

a flexible support structure (12), on an upper side (12*b*) of the support structure (12), an active layer (14) with a binder (16) and abrasive grains (15) held in said binder (16), wherein a transponder device (9) is affixed to an underside (12*a*) of the endless abrasive belt (8), said transponder device (9) comprising an attachment region (26) and a flag (28), said attachment region (26) being glued onto said underside (12*a*) by means of an adhesive layer (20), said flag (28) being held by said attachment region (26) and projecting laterally away from said endless abrasive belt (8), and a transponder (21) including a transponder chip (22) and an aerial (23) for a wireless data connection with said sanding machine (1) is arranged in said flag (28).

2. The endless abrasive belt (8) according to claim 1, wherein said flag (28) is held directly by said attachment region (26).

3. The endless abrasive belt (8) according to claim 1, wherein said attachment region (26) comprises an elongated extension, whereby said attachment region (26) exhibits a mounting angle (α) unequal to 90° in relation to a lateral edge (8*c*) of said endless abrasive belt (8), for creating a diagonal course of said attachment region (26) on the underside in relation to a transport direction (t).

4. The endless abrasive belt (8) according to claim 3, wherein the mounting angle (α) lies in a range between 10° and 80°.

5. The endless abrasive belt (8) according to one claim 1, wherein said transponder chip (22) is designed as an RFID chip (22) which is followed by the aerial (23) as a planar structure.

6. The endless abrasive belt (8) according to claim 1, wherein said transponder device (9) comprises a plastics strip (19) with an adhesive layer (20) provided on its underside (19*a*), said plastics strip (19) being glued onto said endless abrasive belt (8) in such a way that it creates said attachment region (26) on said endless abrasive belt (8), and said flag (28) being formed by a projecting region of said plastics strip (19).

7. The endless abrasive belt (8) according to claim 6, wherein said plastics strip (19) is flipped over or bent inwards, for creating said flag (28), in such a way that said adhesive layer (20) comes into contact with itself.

8. The endless abrasive belt (8) according to claim 7, wherein said plastics strip (19) is flipped over in the region of a predetermined bending line (25).

9. The endless abrasive belt (8) according to claim 8, wherein said predetermined bending line (25) is designed to include a perforation or weakened region.

10. The endless abrasive belt (8) according to claim 6, wherein said transponder (21), being a transponder sticker (21), is glued onto said plastics strip (19).

11. The endless abrasive belt (8) according to claim 10, wherein said transponder (21), being a transponder sticker (21), is glued onto a non-adhesive upper side (19*b*) of said plastics strip (19).

12. The endless abrasive belt (8) according to one claim 1, wherein on said transponder chip (22) one or more of the following data are stored and can be read out by the detector (10):

grain size of the endless abrasive belt (8), shipment date, series, contact pressure, pressure force (F), time of operation, distance of operation, running velocity of the endless abrasive belt (8).

13. The endless abrasive belt (8) according to claim 12, wherein said detector (10) can also write data, in particular, data related to wear, onto said transponder chip (22).

14. The endless abrasive belt (8) according to claim 13, wherein said detector (10) can also write data related to time of operation and/or distance of operation and or a wear-related index onto said transponder chip (22).

15. The endless abrasive belt (8) according to claim 14 wherein said index is formed as a function of the time of operation and the pressure force during the time of operation.

16. The endless abrasive belt (8) according to claim 1, wherein said support structure (12) is made of paper material or of textile material, e.g. fabric or fleece.

17. The endless abrasive belt (8) according to claim 1, wherein said underside (12*a*) of the endless abrasive belt (8) is formed by the underside (12*a*) of said support structure (12) and said transponder device (9) is attached to said underside (12*a*) of said support structure (12).

18. The endless abrasive belt (8) according to claim 1, wherein said transponder (21) lies completely laterally outside said support structure (12) and said active layer (14).

19. The endless abrasive belt (8) according to claim 18, wherein said transponder (21) lies in parallel alignment to said support structure (12).

20. A sanding machine (1) comprising:

a grinding cylinder (3), a tension roller (4), a controller device (6), an input and output unit (7), the endless abrasive belt (8) according to claim 1 which is clamped between said tension roller (4) and said grinding cylinder (3), a drive (5) for driving said grinding cylinder (3) and/or of said endless abrasive belt (8), and a detector (10), sending out wireless query signals, in particular, RFID query signals (R1) to said transponder device (9) of said endless abrasive belt (8) and receiving wireless response signals (R2) transmitted by said transponder device (9) and, as a function of said response signals (R2), putting out detection signals (S1) to said controller device (6).

21. The sanding machine (1) according to claim 20, wherein said controller device (6) derives stored process parameters of said transponder device (9) from said detection signals (S1) and checks, by means of said process parameters, the drive (5), in particular, a pressure force (F) and/or belt velocity (v), and, as a function of the check, puts out a messaging signal or error signal (S2) to said input and output device (7) to inform the user.

22. The sanding machine (1) according to claim 21, wherein said controller device (6) checks a pressure force (F) and/or belt velocity (v) by means of said process parameters.

23. The sanding machine (1) according to claim 20, wherein it comprises a writable and readable memory (6*a*) for storing wear-dependent data of one or more endless abrasive belt(s) (8), in particular, including data sets containing an unambiguous identification number of said endless abrasive belt(s) (8).

* * * * *